US005673536A

United States Patent [19]

Easter et al.

[11] Patent Number: 5,673,536

[45] Date of Patent: Oct. 7, 1997

[54] CARTON FLAP FOLDING METHOD AND APPARATUS

[75] Inventors: William M. Easter, Roswell; James Emerson; Peter Karst, both of Woodstock; Jay Steinbuchel, Marietta, all of Ga.

[73] Assignee: Riverwood International Corporation, Atlanta, Ga.

[21] Appl. No.: 685,204

[22] Filed: Jul. 23, 1996

[51] Int. Cl.[6] ..... B65B 21/24; B65B 49/12; B65B 27/04

[52] U.S. Cl. ..... 53/398; 53/48.7; 53/48.8

[58] Field of Search ..... 53/398, 48.7, 376.7, 53/377.2, 387.2, 48.8, 48.9, 462, 466, 228

[56] References Cited

U.S. PATENT DOCUMENTS

| | | | |
|---|---|---|---|
| Re. 26,750 | 1/1970 | Ganz | 53/48.7 X |
| 3,182,431 | 5/1965 | Ganz | 53/48.7 X |
| 3,187,479 | 6/1965 | Ganz | 53/398 |
| 3,303,631 | 2/1967 | Ganz | 53/48.7 |
| 3,572,003 | 3/1971 | Perry et al. | 53/398 |

*Primary Examiner*—Horace M. Culver

[57] ABSTRACT

A carton flap folding method and apparatus for use on a continuous motion packaging machine is disclosed. The carton flap folding apparatus includes a spaced pair of generally parallel knock-down arms which are rotated in the direction of a path of travel extending along the packaging machine and on which a spaced series of groups of articles for being packaged are moved. Each group of articles is at least partially enclosed in a carton blank having at least one flap hingedly connected thereto for being closed on at least a portion of the group of articles. The carton flap folding apparatus moves the knock-down arms into engagement with the at least one open flap of the carton blanks in the direction of the path of travel at substantially the same speed as the speed of the group of articles along the path of travel. The carton flap folding apparatus decreases the speed of the knock-down arms in the direction of the path of travel with respect to the group of articles prior to engaging the at least one open flap of the carton blank, and increases the speed of the knock-down arms in the direction of the path of travel with respect to the speed of the group of articles for disengaging the knock-down arms from the at least one hinged flap of the carton blank.

27 Claims, 7 Drawing Sheets

CARTON FLAP FOLDING METHOD AND APPARATUS

FIELD OF THE INVENTION

This invention relates in general to packaging machinery ad to methods of packaging articles into containers. More particularly, this invention relates to continuous motion packaging machines which fold a prestored canton blank at lest partially about a group of articles being moved along a path of travel on the packaging machine.

BACKGROUND OF THE INVENTION

Continuous motion packaging machines for packaging articles are well known in the art. Continuous motion packaging machines typically group a selected number of articles, for example, beverage containers, into a desired configuration, whereupon the articles are then packaged in a cannon or paperboard carrier. When packaging beverage containers, for example, the articles are typically provided to the machine in a randomly ordered series, the packaging machine then ordering the articles into a spaced series of individual articles, or groups of articles, which are moved along a path of travel on the packaging machine for being packaged in a continuous motion operation.

As known to those skilled in the art, these groups of articles may be moved into at least one of the open ends of a preformed, sleeve-type carton having at least one open flap which is hingedly connected to the carton and is closed on the carton during the packaging operation. Another well known form of packaging groups of articles, however, is to use a prescored wrap-type carton blank on a wrapping machine constructed to place the carton blank on or at least partially about a portion of a group of articles as it is moved along the path of travel, whereupon the prescored flaps of the carton blank are folded to enclose the group of articles as it moves along the path of travel. Examples of wrap-type groups of articles include three packs, four packs, six packs, eight packs, and twelve packs of soft drink or beer containers.

Unlike sleeve-type carton blanks, which tend to be more stable due to their being formed as an open-ended tubular sleeve, wrap-type carton blanks tend to be more unstable during packaging operations due to the fact that the wrap-type carton blank is oftentimes placed, or balanced, on top of a moving group of articles on a packaging machine. Common examples of wrap-type carton applications include over the crown wrap-type cartons which are placed on the tops of the containers, for example on the caps of beer bottles or soft drink bottles, in which the carton blank rests only on top of the group of articles moving along the path of travel, and neck-through wrap-type canons which are extended downward over at least a portion of the upwardly extending neck of a bottle or other beverage container. Neck-through wrap-type cartons tend to be more stable during packaging operations than over the crown wrap-type cartons, however, both of these types of wrap-type cartons still tend to be less stable than sleeve type cartons when packaging articles therein.

Early packaging machines used a static plow, or series of static plows or guides for receiving the unfolded or partially folded flaps of wrap-type carton blanks to guide and thus complete the folding of the flaps about the groups of articles. Although static plows proved to be a reliable and durable means of folding the flaps of wrap-type cartons, these devices were best suited for relatively low speed packaging operations. As production line speeds increased, the problem arose that the static plows or guides of the known art tended to drag the cartons back with respect to the movement of the groups of articles along the path of travel thus misaligning the canons for further processing downstream. Thus, in order to lessen the problem of carton drag caused by static plows, the use of rotary knock-down arms became common in the industry.

Common examples of rotary knock-down arm devices used for folding the flaps of wrap-type carton blanks would feature at least one knock-down arm, and in most cases a pair of parallel knock-down arms. The knock-down arms are typically swept back or shaped to have a leading edge for engaging the carton blank side flaps, and a trailing edge for folding the carton blanks as the group of articles moves along the packaging machine. As known in the art, knock-down arm carton flap folding devices use constant speed knock-down arms which are moved in the direction of the path of travel in timed relationship with the machine, and in particular with the flight conveyor moving the groups of articles along the path of travel. The inherent drawback with this type of knock-down arm canon flap folding device, however, is that the designs of the knockdown arms themselves are oftentimes article specific so that different knock-down arm designs are needed for each separate and differing type of groups of articles to be packaged on the machine.

For example, one knock-down arm design may be used for over the crown four packs, whereupon a different knock-down arm design will be required for neck-through six packs, and so on. This has been required due to the different geometry of the articles being packaged, as well as the differing groupings of articles in conjunction with the type of carton blank being wrapped about the group of articles on the packaging machine. Thus, when changing over a production run from one type of group of articles to a second group of articles, for example an over the crown six pack to a neck-through eight pack, the packaging machine would have to be shut down and the knock-down arms replaced with the appropriate knock-down arms designed for the group of articles to be packaged, as well as for the carton blank to be used. Packaging operations can only be resumed once any necessary calibration of the knock-down arms with respect to the carton blanks being used are completed prior to resuming full speed packaging operations. Not only does this minimize production efficiency, it also increases production costs by requiring the physical change-over of the packaging machine for each group of articles to be packaged.

Thus, neither the static plows nor the conventional constant speed knock-down arms used in packaging operations provide the needed flexibility for high speed packaging operations. What is needed, therefore, but seemingly unavailable in the art, is a universal carton flap folding method and apparatus which does not require the physical change over of components for packaging differing groups of articles, to include differing sizes of articles, differing groupings of articles, as well as differing packaging requirements for the groups of articles. A canon flap folding method and apparatus is also needed which is automated so that the change over from one series of packaging operations to the next can be done without requiring machine technicians to reset any of the physical parameters of the packaging machine prior to changing over packaging operations for differing articles or groups of articles.

Rather than designing the knock-down arms for the articles to be packaged and/or the type of article groupings to be used, a universal carton flap folding apparatus is needed which will use the same knock-down arms or flap tucking devices for any type of article grouping or carton blank used to package the articles, and which does so quickly, easily, and economically. Moreover, an improved carton flap folding method and apparatus is needed for use with modem packaging machines which are adapted to wrap a large variety of articles, article sizes, and article groupings on a single machine with the ability to fold wrap-type carton blanks at a rate sufficient to match production speeds. Thus, what is needed is an improved carton flap folding method and apparatus which maximizes the ability to wrap articles in synchronization with the operation of the packaging machine to realize the full benefits and efficiency of modem packaging machinery.

SUMMARY OF THE INVENTION

The present invention provides an improved carton flap folding method and apparatus for use on continuous motion packaging machines which overcomes some of the design deficiencies of other carton flap folding devices known in the art. The carton flap folding method and apparatus of this invention provides a highly flexible method and apparatus of automatically folding the flaps of wrap-type cartons, and is equally well suited to fold the open end flaps of sleeve-type cartons, about preformed groups of articles being moved on a path of travel along a continuous motion packaging machine. The improved method and apparatus of this invention can be matched to the production needs of the packaging machine and/or packaging operations with which the method and apparatus of this invention are used, and thus provides a much greater degree of flexibility than heretofore known in the art. Packaging machine operators will now be allowed to package articles of a variety of sizes and of differing article group configurations on a single continuous motion packaging machine constructed to automatically time the movement, and vary the speed, of the knock-down arms with respect to the groups of articles being moved along the path of travel on the packaging machine. Thus, this invention provides a simple and efficient method and apparatus that is readily adapted for use in both high speed and low speed packaging operations, and is well suited for use with a large number of article types and/or article groupings and configurations without the need for sophisticated machinery or other devices.

This invention attains a high degree of flexibility, yet maintains simplicity in design and operation, by teaching a method of automatically packaging a preformed group of partially enclosed articles being moved along a path of travel on a packaging machine in a prescored carton blank having at least one generally open flap hingedly connected thereto. The novel method of this invention includes the steps of moving a carton flap folding device positioned on the packaging machine with respect to the path of travel in the direction of the path of travel to engage at least one open flap of the carton blank, folding the at least one open flap of the carton blank into a generally closed position on the carton thereby, and then varying the speed of the flap folding device in the direction of the path of travel with respect to the speed of the group of articles thereon.

The improved method of this invention also includes the step of moving the flap folding device in the direction of the path of travel and at substantially the same speed as the speed of the group of articles along the path of travel while engaged with the at least one open flap of the carton blank. Moreover, this method includes the step of decreasing the speed of the flap folding device in the direction of the path of travel with respect to the speed of the group of articles prior to engaging the at least one open flap of the carton blank, and of disengaging the flap folding device from the at least one open flap of the carton blank while increasing the speed of the flap folding device in the direction of the path of travel with respect to the speed of the group of articles. Thus, the method of this invention is equally well-suited for wrap-type carton blanks as well as for open ended sleeve-type carton blanks having at least one flap hingedly connected thereto.

The carton flap folding apparatus of this invention is constructed for use on a packaging machine on which a spaced series of preformed groups of articles are moved along a path of travel, each of the groups of articles being at least partially enclosed in a prescored carton, each carton having at least one open flap hingedly connected thereto for being closed on the carton. The carton flap folding apparatus of this invention includes a framework supported on the packaging machine with respect to the path of travel, and at least one knock-down arm supported on the framework for rotation in the direction of the path of travel constructed for engagement with the at least one open flap of the cartons as the groups of articles are moved along the path of travel. A drive for rotating the at least one knock-down arm in the direction of the path of travel is provided, as is a speed control for varying the speed of the at least one knock-down arm in the direction of the path of travel with respect to the speed of the group of articles moving along the path of travel.

The speed control of this invention is constructed and arranged to decrease the speed of the at least one knock-down arm in the direction of the path of travel with respect to the speed of the group of articles moving along the path of travel and to move the at least one knock-down arm into engagement with the at least one open flap of each carton as each group of articles moves along the path of travel. The speed control is also constructed and arranged to move the at least one knock-down arm in the direction of the path of travel at substantially the same speed as the speed of the group of articles along the path of travel while engaged with the at least one open flap of each carton blank, and is further constructed and arranged to increase the speed of the at least one knock-down arm in the direction of the path of travel with respect to the speed of the group of articles along the path of travel to disengage the at least one knock-down arm from the at least one open flap of the carton blank in response thereto.

In a preferred embodiment of the apparatus, a pair of spaced and generally parallel knock-down arms are supported on the apparatus framework positioned with respect to the path of travel, and are constructed for rotation in the direction of the path of travel. Both knock-down arms are supported on a driven pulley assembly spaced from a drive pulley, a toothed timing belt encircling both pulleys, with a servomotor powering the drive pulley through a gear reducer for rotating the knock-down arms in the direction of tile path of travel. A preferred embodiment of the speed control of this invention includes a computer having a central processor and an internal memory, or access to a computer-readable medium, in or on which at least one electronic cam profile is stored. The electronic cam profile controls the speed of the servomotor through a servo control processor for that servomotor. The memory of the control processor may include a plurality, for example a table, of electronic cam profiles stored in memory, or may include the appropriate computer program needed to calculate the appropriate electronic cam profiles in response to changing machine conditions and/or packaging requirements.

Accordingly, the unique structure of this invention, as well as the method practiced by this invention, results in an improved carton flap folding method and apparatus which allows a single continuous motion packaging machine to be used with a variety of article sizes and groupings or configurations. Moreover, the method and apparatus of this invention provides for an automated carton flap folding method and apparatus which does not generally require the manual or physical intervention of a technician to change over the carton flap folding apparatus for packaging differing sized articles or article groupings, and to do so quickly, efficiently, and economically. Accordingly, the objects of the present invention include the ability to quickly and automatically change the carton flap folding apparatus into different configurations in order to process articles of differing diameters or heights, and to permit various article configurations to be packaged on the same machine with minimal production down time. The present invention accomplishes the above-stated objects while providing for flexible, efficient, and continuous article packaging.

DETAILED DESCRIPTION OF THE PREFERRED EMBODIMENT

Figure 2:
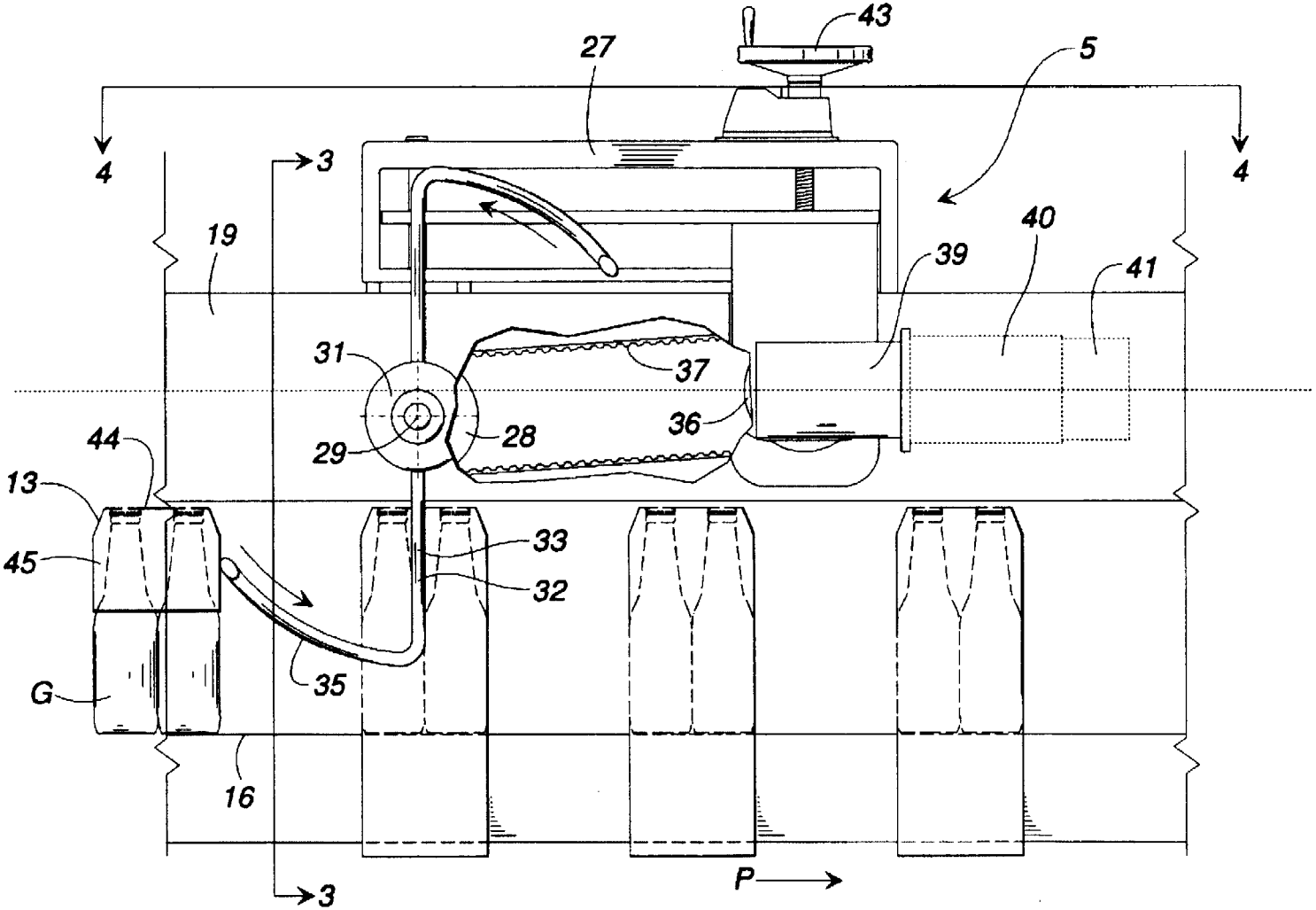
FIG. 2 is a side-elevational view of the preferred embodiment of the carton flap folding apparatus of this invention.
Figure 5:
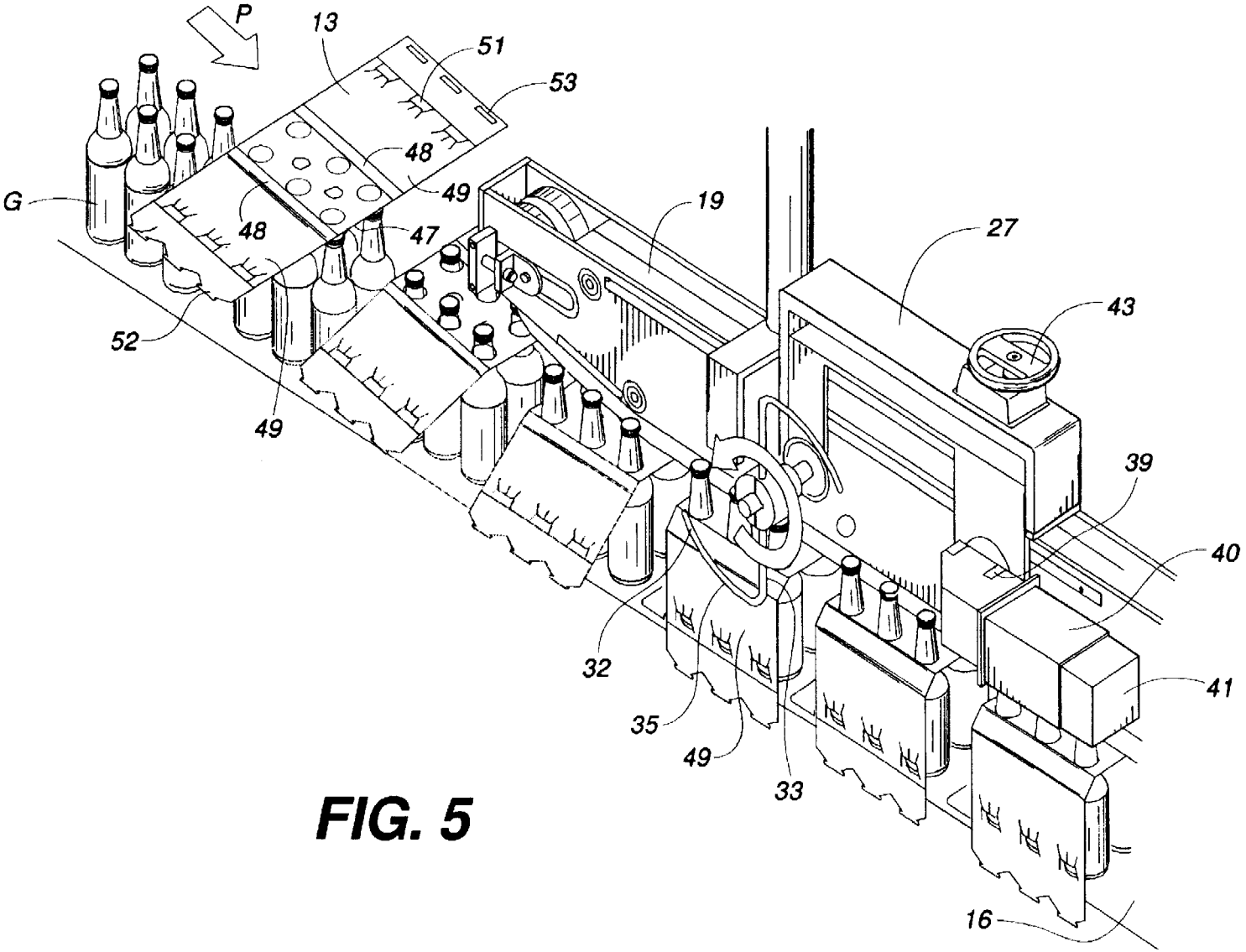
FIG. 5 is a partial perspective view of the preferred carton flap folding apparatus of this invention in use on a continuous motion packaging machine.

Referring now to the drawings in which like reference numerals indicate like parts throughout the several views, numeral 5 illustrates a preferred embodiment of the carton flap folding apparatus of this invention positioned on a continuous motion packaging machine 7. Packaging machine 7 has an infeed end 9 and a spaced discharge end 11, along which a path of travel, denoted by the reference character "P", extends. Packaging machine 7 is provided with a storage magazine 12 at infeed end 9, and supplied with a plurality of carton blanks 13, illustrated in FIGS. 2, 3, and 5, for placement by an overhead carton blank feed assembly 15 onto separate groups of articles, denoted by the reference character "G" and shown in FIGS. 2 and 5. As shown in FIGS. 2 and 5, the groups of articles are beverage containers, and in particular, long-necked bottles. However, it is anticipated that the groups of articles G may also include short-necked bottles as well as beverage cans and other types of beverage containers used in the packaging industry.

Figure 1:
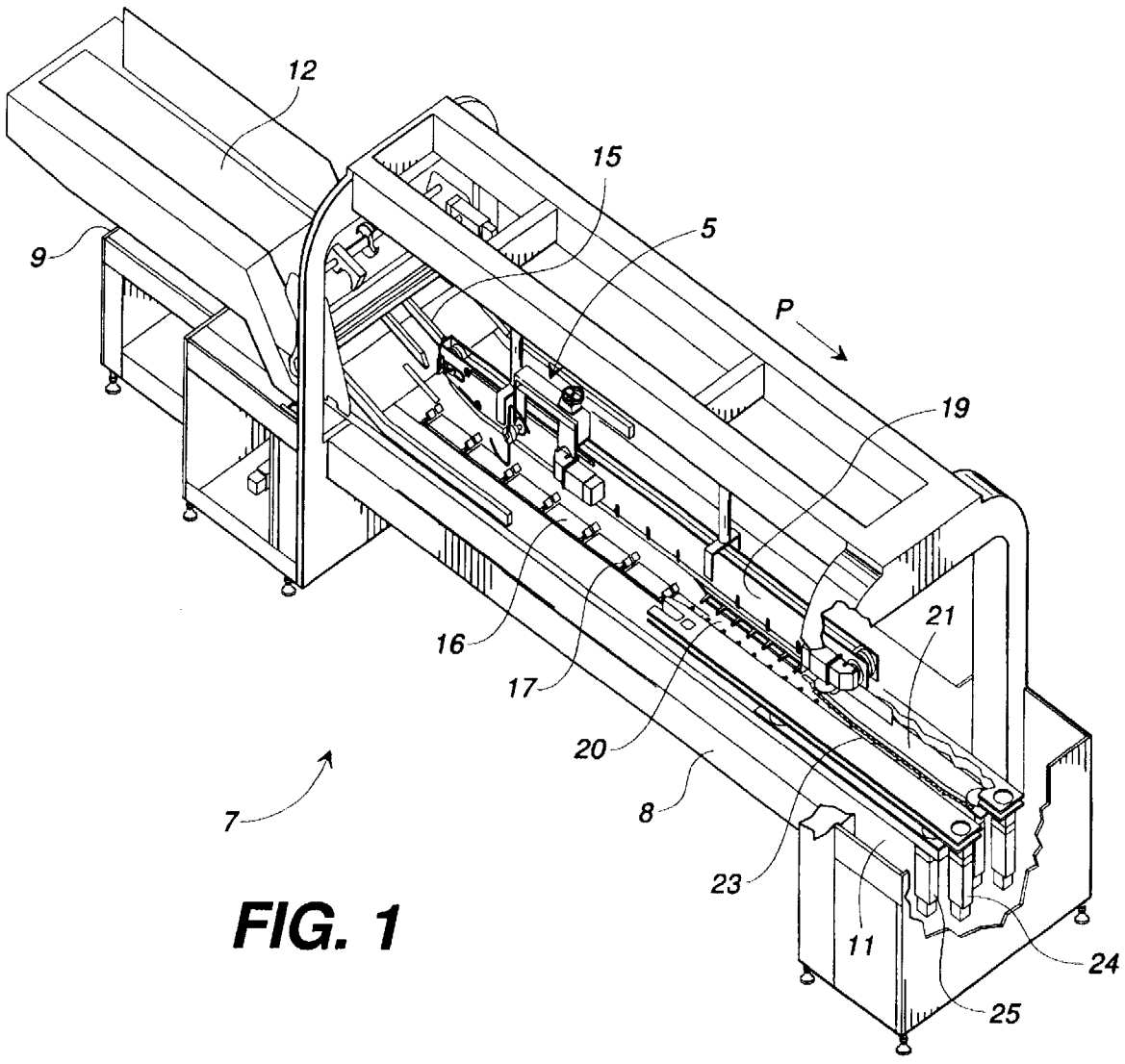
FIG. 1 is perspective view of a preferred embodiment of the carton flap folding apparatus of this invention positioned on a continuous motion packaging machine.

Still referring to FIG. 1, packaging machine 7 includes an endless flight conveyor 16 extending along the path of travel and having a spaced series of lugs 17 for moving each group of articles in spaced series along the path of travel from the infeed end toward the discharge end of the packaging machine. Although a flight, or pitched, conveyor 16 is shown in FIG. 1, carton flap folding apparatus 5 of this invention is equally well suited for use with the conventional endless conveyor belts known in the art which are not otherwise divided into flights, known to those skilled in the art as a pitchless or tape conveyor belts.

Figure 6:
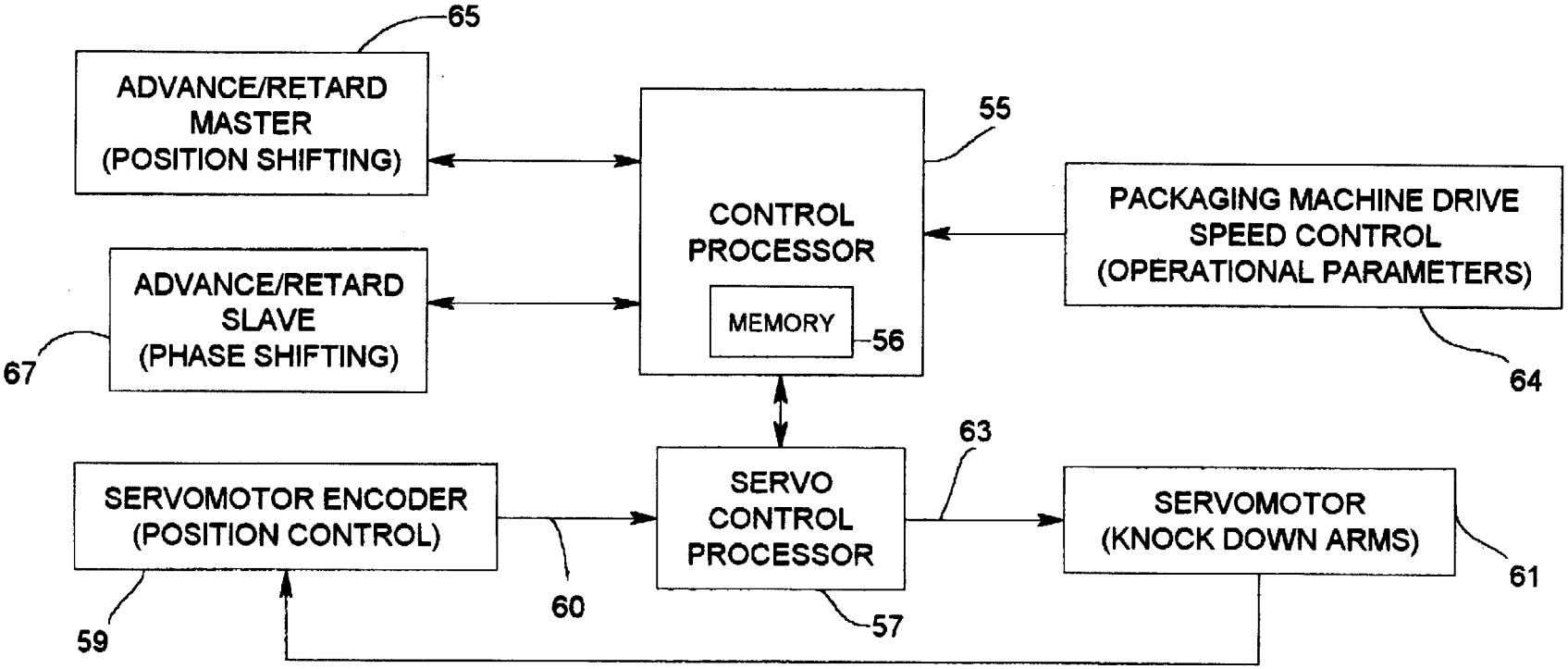
FIG. 6 is block diagram of the control system of the carton flap folding apparatus of this invention.

Flight conveyor 16 of FIG. 1 may be variable pitched lug conveyor of the type shown in U.S. patent application Ser. No. 08/577,188, filed on Dec. 22, 1995, the material portions of which are incorporated herein by reference. So constructed, flight conveyor 16 may be used for varying the pitch, and thus the spacing, of the groups of articles as they are moved along the packaging machine, thus providing for a high degree of flexibility in packaging operations. Although not illustrated specifically in FIG. 1, flight conveyor 16 is powered in known fashion using a servomotor (not illustrated) having an integral encoder (not illustrated) in electronic communication with a control processor 55 (FIG. 6).

Carton flap folding apparatus 5 is supported on overhead flight conveyor assembly 19 supported on framework 8 of the packaging machine. In known fashion, overhead flight conveyor assembly 19 can be moved toward and away from flight conveyor 16, and extends along the path of travel in substantial alignment with flight conveyor 16. Thus, and as shown in FIG. 1, overhead flight assembly 19 may include the overhead pusher lug assembly for packaging machines disclosed in U.S. patent application Ser. No. 08/271,297, and filed on Jul. 6, 1994, the material provisions of which are incorporated herein by reference. Overhead flight assembly 19 is used to stabilize the carton blanks 13 as they are conveyed progressively through the packaging machine on the groups G of articles, as shown generally in FIGS. 2 and 5.

Positioned along at least a portion of flight conveyor 16, and extending downstream from the flight conveyor and along the path of travel, is a side lug conveyor 20 for moving the partially packaged groups of articles on a dead plate (not illustrated) toward a tab folding assembly 21 constructed and arranged to fold the appropriate bottle locking tabs 51 (FIG. 5) inwardly of the carton blank in known fashion for securing each of the beverage containers in position with respect to one another within the carton blank, and for moving carton locking tabs 52 (FIG. 5) into carton locking slots 53 (FIG. 5) to enclosed the carton blank about the group of articles prior to discharge from the packaging machine. Both side lug conveyor 20 and tab folding assembly 21 are included as part of the discharge conveyor assembly 23 located at the discharge end of the packaging machine and through which packaged groups of articles are passed for further processing and/or handling. Side lug conveyor 20 is operated by side lug conveyor drive assembly 24 illustrated in FIG. 1, and tab folding assembly 21 is powered by tab folding assembly drive 25, also illustrated in FIG. 1. Although not illustrated in specific detail, it is anticipated that side lug conveyor drive assembly 24, and tab folding assembly drive 25 will each include at least one servomotor with an integral encoder (not illustrated) in communication with control processor 55 (FIG. 6). Packaging machine 7, as illustrated in FIG. 1, may thus include the MARKSMAN series of continuous motion packaging/wrapping machines manufactured by Riverwood International Corporation of Atlanta, Ga.

Figure 3:
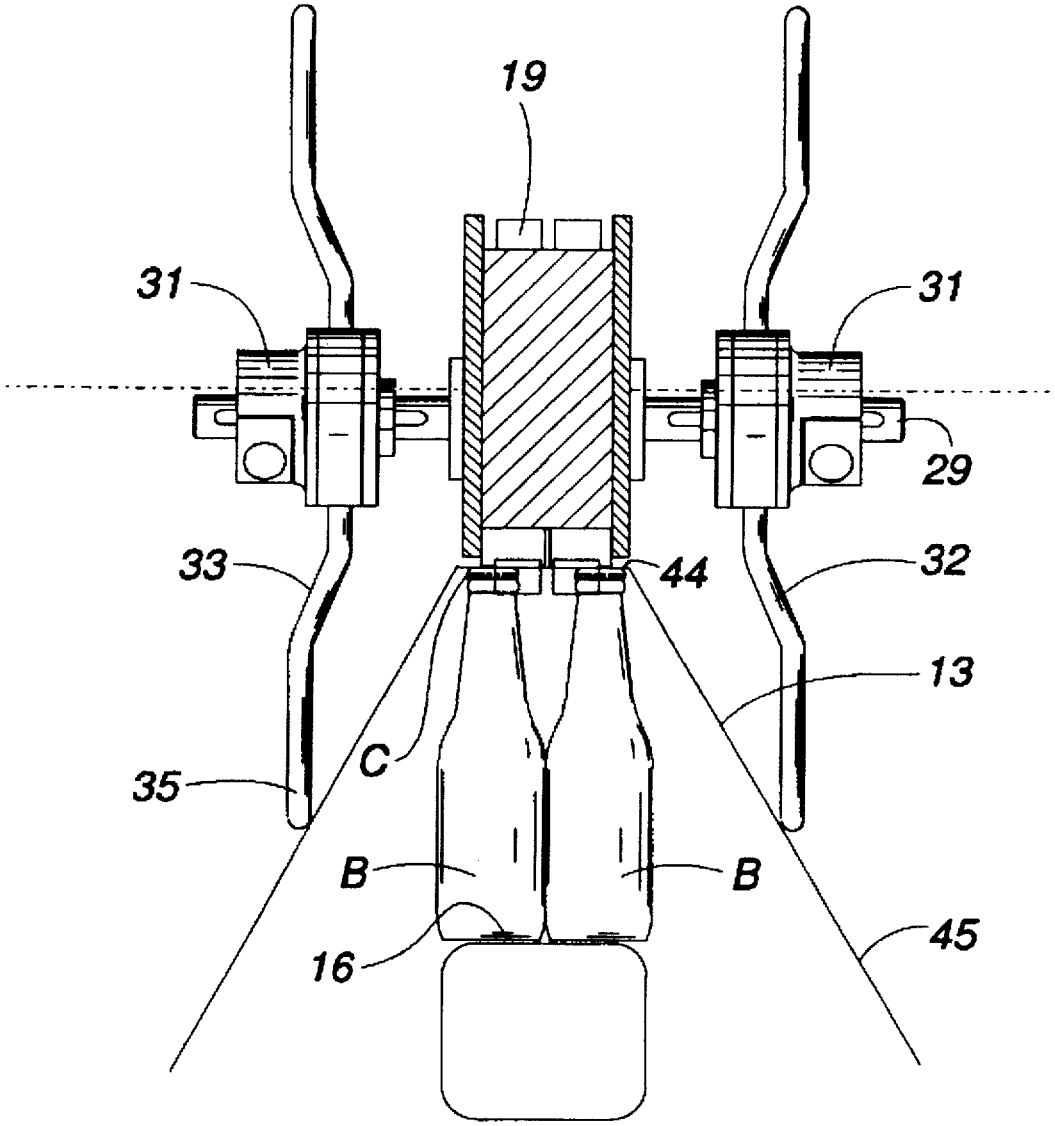
FIG. 3 is an end-elevational view along line 3—3 of FIG. 2.
Figure 4:
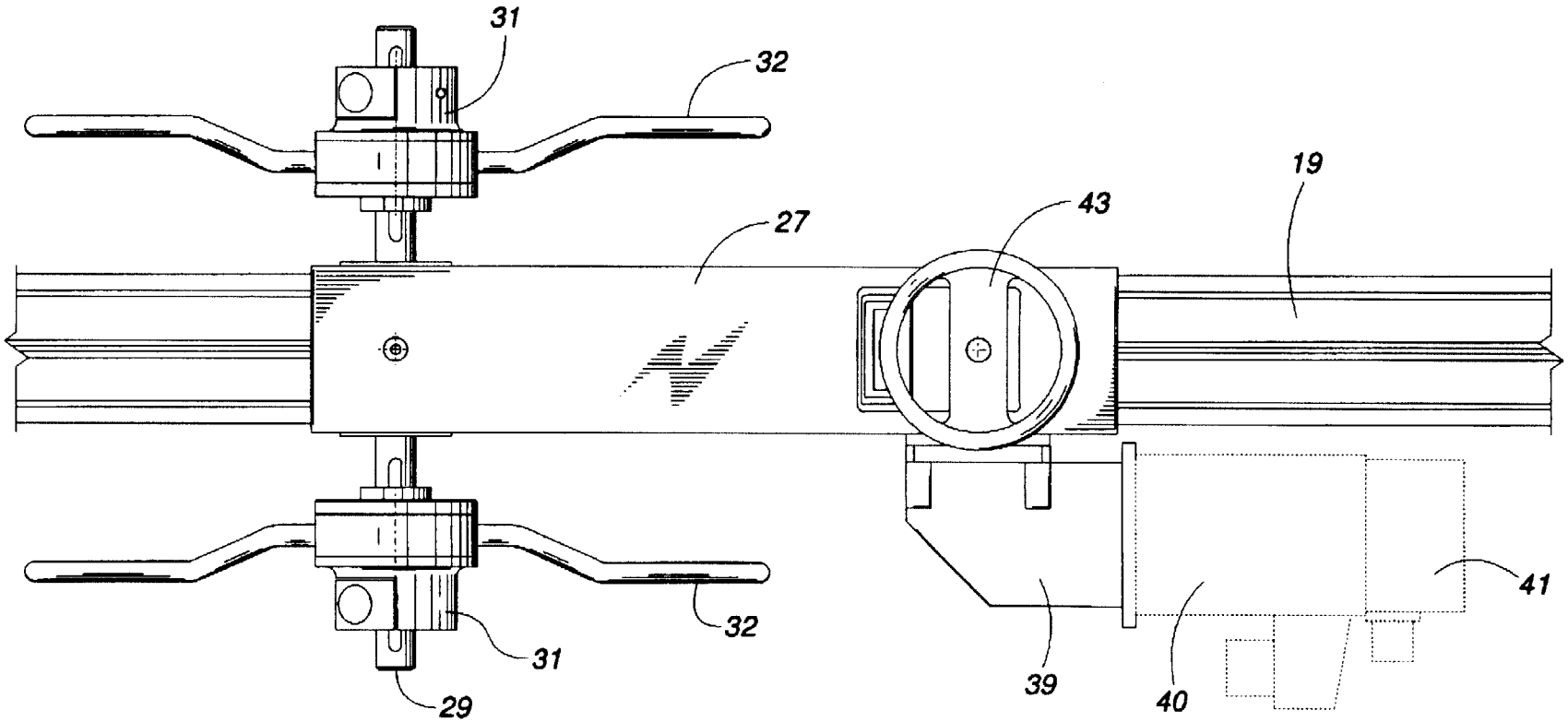
FIG. 4 is a top plan view along line 4—4 of FIG. 2.

Carton flap folding apparatus 5 is illustrated in greater detail in FIGS. 2–4. In FIG. 2, carton flap folding apparatus 5 is shown having a framework 27 supported on overhead flight assembly 19. Framework 27 supports at its upstream end, i.e., the end closest to infeed end 9 of the packaging machine, a driven pulley assembly 28 having a cross shaft 29 (FIGS. 2, 3, 4) rotatably supported on framework 27 on which a spaced pair of hubs 31 are mounted, hubs 31 being fastened thereto with conventional threaded fasteners. Cross shaft 29 may be provided with a series of slotted openings (not illustrated) if so desired, through which the threaded fasteners (not illustrated) securing hubs 31 to cross shaft 29 may be placed so that hubs 31 may be properly spaced with respect to flight conveyor 16 and the groups of articles G being moved thereon for packaging.

As best shown in FIGS. 2 and 5, each one of hubs 31 has a pair of knock-down arms 32 in substantial alignment with one another fastened thereto or formed as part thereof. Each knock-down arm 32 has an elongate leading edge 33 extending away from hub 31, each leading edge 33 being formed into an arcuate portion 34 from which an elongated trailing edge 35 extends. The specific geometric design of knock-down arms 32 shown in FIGS. 2-5 is illustrative only as knock-down arms are well known in the art, and a great number of knock-down arm designs has evolved over time for use in continuous motion packaging machines. What is required here is that knock-down arms 32 be so constructed and arranged for engagement on the side flaps, or the open end flaps of a carton blank, and that they be so sized and shaped that they may be moved in engagement with the carton blank as it moves along at least a portion of the path of travel for folding the side flaps at least partially about the articles to be packaged, as shown in FIG. 5.

Referring again to FIG. 2, framework 27 of carton flap folding apparatus 5 also rotatably supports a drive pulley 36 over which a timing belt 37 is passed, timing belt 37 encircling both the driven pulley assembly 28 and drive pulley 36. Timing belt 37, as shown in FIG. 2, is a toothed timing belt, and both driven pulley assembly 28 and drive pulley 36 include a toothed pulley (not illustrated) on which the timing belt is engaged. Although timing belt 37 is shown as a flexible toothed belt, it is anticipated that a V-shaped drive belt or other flexible drive belt, could be used for rotating knock-down arms 32 in the direction of the path of travel, and/or that a drive chain could be used and received on sprockets instead of pulleys, in known fashion.

Drive pulley 36 is operably fastened to a gear reducer 39 supported on framework 27, gear reducer 39 in turn being operably fastened to a servomotor 40. Servomotor 40 includes, in known fashion, an encoder 41 for digitally signalling the rotational position of servomotor 40 to control processor 55. The control system employed by carton flap folding apparatus 5, in particular that used to control servomotor 40, is illustrated more fully in FIG. 6, and discussed in greater detail below.

As shown in FIGS. 2 and 4, framework 27 includes a height adjustment assembly 43 which is provided for raising and lowering the framework of the carton flap folding apparatus on overhead flight assembly 19 and with respect to flight conveyor 16, as well as with respect to the groups of articles G being moved on the flight conveyor and along the path of travel. Although height adjustment assembly 43 is shown as a manual adjustment assembly, it is anticipated that an automated height adjustment assembly could be used if so desired. Moreover, and although height adjustment assembly 43 is illustrated in FIGS. 2 and 4, it is anticipated that the novel operational method of this invention will not require the height adjustment of framework 27 with respect to flight conveyor 16 during operation, nor during change over for packaging articles of differing sizes and configurations on packaging machine 7.

An "over the crown" packaging configuration is illustrated in FIG. 3 in which the top panel 44 of a carton blank having a pair of opposed and hinged side flaps 45 attached thereto is shown positioned on the crowns C, i.e., the bottle caps, of bottles B being moved along flight conveyor 16. This also illustrated in side elevation in FIG. 2. This is typically the most unstable arrangement in which a wrap-type carton blank is used, and is the arrangement in which the carton blank is most prone to misalignment with respect to the group of bottles as it moves along the path of travel when using the static plows or conventional knock-down arm assemblies of the known art. As shown in FIG. 3, the leading edge 33 of each one of a spaced pair of parallel knock down arms 32 has engaged side flaps 45 of carton blank 13, and has pushed the side flaps downwardly with respect to the upwardly standing bottles, whereupon arcuate portion 34 transitions trailing edge 35 into engagement with the side flaps to complete the folding of the side flaps at least partially about the group of articles, here bottles B, as they move along the path of travel.

As discussed in greater detail below, knock-down arms 32 are being rotated in the direction of the path of travel by servomotor 40. For the reasons described in greater detail below, the rate of speed of knock-down arms 32 in the direction of the path of travel is adapted to be varied from the speed of the group of articles in the direction of the path of travel. Thus, knock down arms 32 will be slowed, or decelerated, with respect to the speed of the group of articles prior to, or simultaneous with, leading edge 33 first striking side flaps 45. Thereafter, it is anticipated that arcuate portion 34, and trailing edge 35, will be moved in the direction of the path of travel at substantially the same speed as both carton blank 13 and group of articles G in the direction of the path of travel while engaged on side flaps 45, referred to as the dwell portion of knock-down arm rotation, for folding the side flaps into a downward position, whereupon the now at least partially folded flaps will be engaged with static plows (not illustrated), or by a tab folding assembly 21 as illustrated in FIG. 1, for closure about the group of articles.

Thereafter, it is anticipated that knock-down arms 32 will be moved in the direction of the path of travel at a rate of speed greater than the speed of both carton blank 13 and the group of articles, so that trailing edge 35 will become disengaged with side flaps 45 prior to knock-down arm 32 being decelerated for engagement with the side flaps 45 of the next following group of articles being moved along the path of travel. By employing this control methodology it is possible that one pair of spaced knock-down arms 32, as shown in FIGS. 2–5, can be used for folding the carton flaps on article groups of varying article sizes, as well as varying article group configurations, without the need to change either the design, i.e., the hook geometry, of each knock-down arm, or the size, i.e., the length, of the knock-down arms with respect to the surface of flight conveyor 16 and the groups of articles moving thereon. Additionally, it is anticipated that the use of carton flap folding apparatus 5 as described above, and in greater detail below, will allow larger article groups to be fit more closely to one another along the length of the feed conveyor, in this instance flight conveyor 16, than is now done in the art in that the knock-down arms are now controlled more precisely so that they are less likely to strike the flaps of the carton blanks positioned on the preceding and/or following article groups as the article groups move along the path of travel. Essentially, larger article groups will now be allowed to fit within the same pitch, i.e., the distance from the lead article of a first article group to the lead article of the next following article group, previously used for relatively smaller article groupings, thus allowing a more "dense" placement of the article groups on the packaging machine to maximize packaging machine efficiency.

For example, with the constant speed known knock-down arm assemblies differing lengths of knock-down arms will be required depending on the types of bottles being used. If long-neck bottles B such as those shown in FIG. 3 are used, a shorter leading edge 33 will be used as it will engage the side flaps 45 of carton blank 13 sooner than would the leading edges 33 of the knock-down arms 32 shown in FIG. 5, in which a neck-through configuration is used, the leading edge of each knock-down arm having to travel further before first striking the side flaps 49 of carton blanks 13 illustrated therein. With this invention, however, by controlling the rotational speed of the knock-down arms as described below, it is anticipated that a single pair of knock-down arms can be used for all types of articles and article configurations, thus overcoming the problems of physically changing not only the knock-down arms for each differing type of article grouping to be packaged, but also providing a universal carton flap folding apparatus for use with packaging machines of any type requiring the folding of a carton side or end flap. Thus it is anticipated that both the apparatus and method of this invention can also be used to fold the open end flaps of a sleeve type carton, for example, being moved along the path of travel on a packaging machine other than a "wrapper" type packaging machine, as shown in FIG. 1.

The control system for carton flap folding apparatus 5 is illustrated in FIG. 6. A control processor 55 formed as part of a conventional computer (not illustrated) is provided, and has a memory 56. The electronic cam profile, or cam profiles, used to control the operation of carton flap folding apparatus 5 will be either stored within memory 56, or will be calculated by a program stored within memory 56 and used to calculate the desired electronic cam profile(s) in response to machine operating conditions/parameters. Control processor 55 is in electronic communication with a servo control processor 57. Servo control processor 57 is in electronic communication with servomotor encoder 59 which emits a drive position signal to servo control processor 57, which in turn emits this data to control processor 55, this data being compared with the operational parameters of the packaging machine, as well as the appropriate electronic cam profile, so that a drive control signal 61 is emitted from central control processor 55 to servo control processor 57, and in turn to servomotor 63 which rotates drive pulley 36 and thus rotates each of knock-down arms 32 in the direction of the path of travel in accordance with the selected (calculated) electronic cam profile.

The control system of apparatus 5 also includes a packaging machine drive speed control 64 which would be comprised of those operational parameters selected or entered for use in operating packaging machine 7. For example, the parameters may include how many groups of articles per minute will be packaged, as well as the phasing, i.e., the spacing, between each respective group in line along the path of travel, group size, carton type, and so on used on packaging machine 7. Control processor 55 is also in communication with an advance/retard master switch 65, and an advance/retard slave switch 67, both of which are provided, in conventional fashion, in a computer (not illustrated) or a computer housing (not illustrated) conventionally supported on framework 8 by an overhead arm or other known mounting apparatus.

Advance/retard master switch 65 of FIG. 6 is used to adjust the position of knock-down arms 32 with respect to each of carton blanks 13 and the groups of articles G on the path of travel so that, for example, the position of leading edge 33 and/or arcuate portion 34 is adjusted with respect to side flaps 49 (FIG. 5), and more particularly that point of angular rotation at which knock-down arm 32 first engages the side flaps of the carton blank. Advance/retard master switch 65 will receive a feedback signal (not illustrated) from control processor 55 which will be illustrated in conventional fashion on the video display monitor fashioned as a part of the computer (not illustrated) in which control processor 55 is housed.

Advance/retard slave switch 67 is used to adjust, or shift, the phase of the electronic cam profile with respect to the periods of deceleration, dwell, i.e., steady state speed in the direction of the path of travel matched to the speed of the group of articles, and acceleration of the knock-down arms with respect to the speed of the groups of articles on flight conveyor 16. Thus, and referring now to FIG. 7, whereas cam profile 70 and cam profile 72 are both shown to dwell at the 90° point along the X-axis of the graph, 360° equalling one carton wrapping cycle for folding the side flaps of two cartons, advance/retard slave switch 67 would be used to move the dwell portion of the cam profile either to the right or left of the 90° mark so that, for example, the dwell would occur at approximately the 60° point as shown for cam profile 74 in FIG. 7. This has the effect of phase shifting the selected cam profile along the X-axis only, and does not otherwise change the cam profile. Control processor 55 emits a feedback signal (not illustrated) to the video display monitor formed as a part of the computer (not illustrated) in which the control processor is housed for visual display. Moreover, and if so desired, the video display (not illustrated) of the computer (not illustrated) in which control processor 55 is housed may also include the appropriate video display devices for illustrating the cam profiles employed by control processor 55, and as illustrated in FIGS. 7 and 8.

OPERATION

Figure 8:
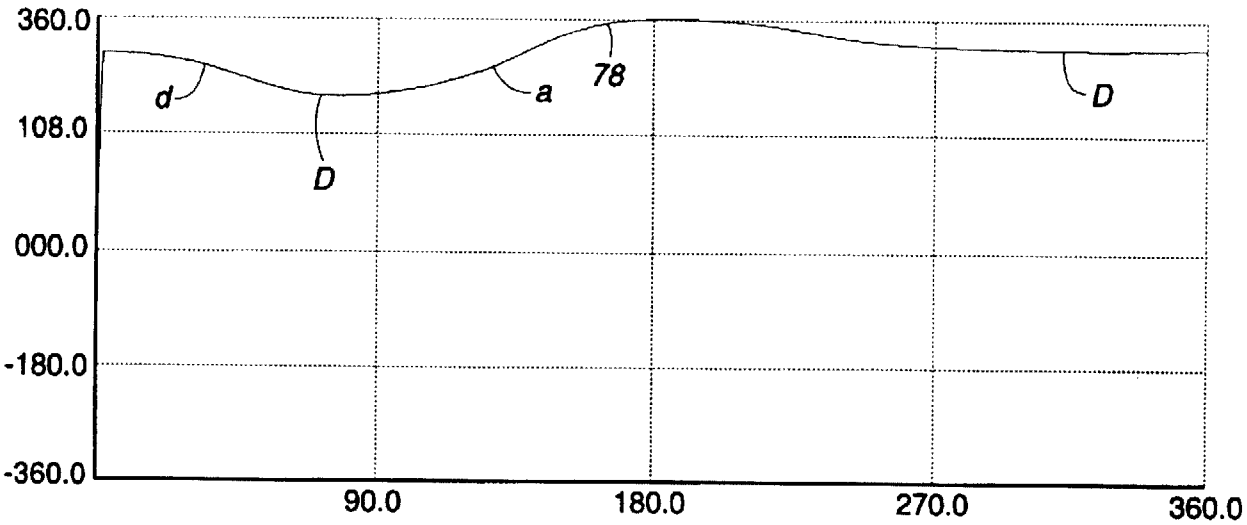
FIG. 8 is a graphical illustration of an illustrative electronic cam profile used by the carton flap folding method and apparatus of this invention for spaced groups of articles moving on a 20 inch pitch on a continuous motion packaging machine.
Figure 7:
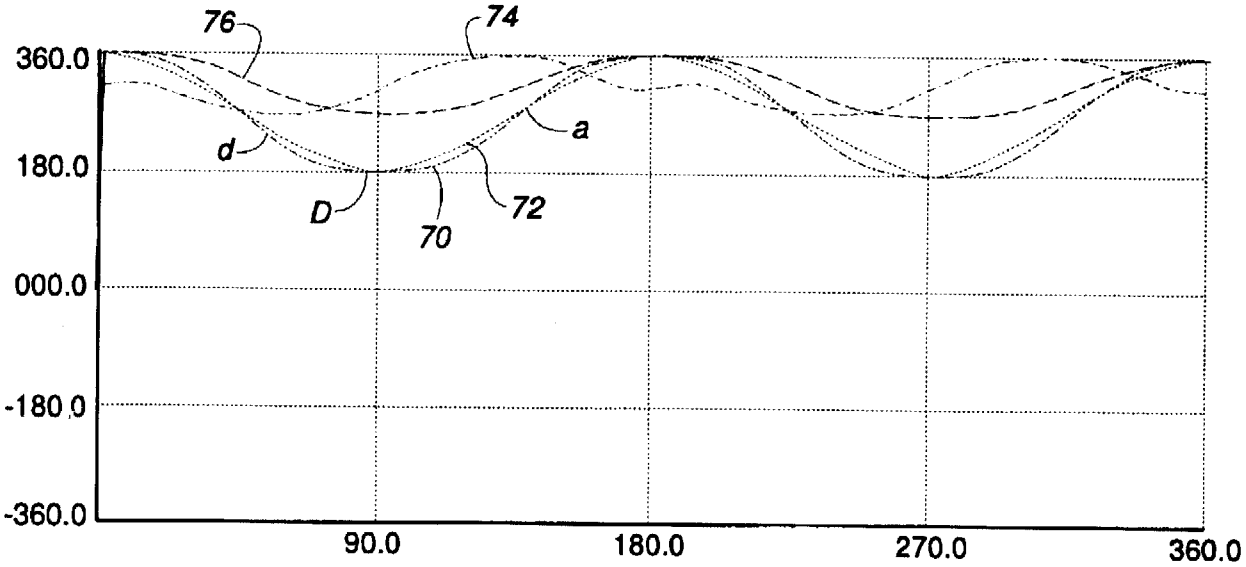
FIG. 7 is a graphical illustration of four illustrative electronic cam profiles used by the carton flap folding method and apparatus of this invention for spaced groups of articles moving on a 10 inch pitch on a continuous motion packaging machine.

The operation of carton flap folding apparatus 5 is illustrated in FIGS. 5, 7 and 8. Referring first to FIG. 5, a spaced series of groups of articles G, in this instance six packs of long neck bottles, is being moved on flight conveyor 16 along the path of travel from the infeed end toward the discharge end of packaging machine 7 (FIG. 1 ). As each group of articles proceeds along the path of travel, carton blank feed assembly 15 (FIG. 1 ) will be supplied with a carton blank 13 from storage magazine 12 (FIG. 1), and will position the carton blank on top of the group of articles as it moves along the path of travel.

In FIG. 5 a neck-through configuration is shown in which the elongated necks of the bottles extend upwardly through a series of spaced apertures defined in top panel 47 of the carton blank. This packaging configuration is more stable than that shown in FIG. 3, an over the crown configuration, in which the carton blank 13 rides on top of the bottle caps of each bottle and is generally a less stable packaging configuration than that shown in FIG. 5; however, by avoiding the use of static plows or guides, or constant velocity knock-down arms, the problems of the art in which the carton blank can become tilted or misaligned with respect to the group of articles is avoided, and much greater control and flexibility over the carton flap folding process is thus obtained.

Still referring to FIG. 5, once a carton blank has been placed on each group of articles by carton blank feed assembly 15, the groups of articles proceed along the path of travel toward carton flap folding apparatus 5. Each group of articles is thus at least partially enclosed by a carton blank prior to being received at the canon flap folding apparatus. As each group of articles and carton blank moves along the path of travel, leading edge 33 of a pair of parallel, spaced knock-down arms 32, one on each of hubs 31 will engage, or strike, each one of spaced side flaps 49 so that the side flaps are moved downwardly with respect to top panel 47, the flaps being folded on prestored lines (not illustrated) formed as a part of top panel 47, comer panels 48, and side flaps 49. Once leading edges 33 have engaged side flaps 49, the rotational speed of the knock-down arms in the direction of the path of travel is decelerated and matched to the linear speed of the groups of articles G along the path of travel so that both knock-down arms 32 move in the direction of the path of travel at substantially the same speed as the speed of each group of articles G during what is referred to as the "dwell" period for each one of the cam profiles illustrated in FIGS. 7 and 8 for ensuring the longest possible period of time in which the knock-down arms are engaged on the side flaps for folding the flaps on the prescored lines of the carton blank.

Thus, and as shown in FIG. 5, knock-down arms 32 are engaged on side flaps 49 of the carton blank and are moving at the same speed as the carton blank and the group of articles along the path of travel so that locking tabs 52 and locking slots 53 are extending downwardly toward the guides (not illustrated) or tab folding assemblies which will be used to insert the locking tabs into the locking slots. Moreover, by varying the speed of knock-down arms 32 with respect to the speed of the group of articles along the path of travel, a precise alignment of the carton blank on the group of articles is maintained, so that for example, each of bottle locking tabs 51 is correctly positioned with respect to each one of bottles B comprising the group of articles G so that the downstream tab folding assembly 21 (FIG. 1) will be aligned with each one of the bottle locking tabs to correctly position and lock the tabs 51 on each bottle, thus securing the bottles within the carton as it encloses the group of articles on the packaging machine.

Once knock-down arms 32 have engaged side flaps 49 and have passed through the "dwell" period of time, the rotational speed of knock-down arms 32 is increased with respect to the speed of group of articles G and carton blank 13 along the path of travel for the purpose of disengaging the knock-down arm, in particular trailing edge 35 thereof, from the carton blank so that the trailing edges do not otherwise strike the carton blank seated on the groups of articles on either side of the group of articles G being moved along the path of travel. For example, if each group of articles G shown in FIG. 5 is spaced apart on a 10 inch pitch, i.e., a distance of 10 inches extends from the lead bottle of each group to the lead bottle of the next succeeding group, and that group of articles is 8½ inches long, then only a 1½ inch gap will separate each group of articles. Should trailing edge 35 of the knock-down arms 32 be out of position or late with respect to its engagement on side flaps 49 of the carton blank, the possibility exists that the rearmost portion of each trailing edge 35 could be caught in the still unfolded carton blank of the next group of articles, for example, thus either damaging the carton blank, and/or misaligning the bottles within the group of articles. Knock-down arms 32 will continue to be rotated at a rate of speed greater than the speed of the group of articles along the path of travel until the knock-down arms reach the deceleration point of the cam profiles shown in FIGS. 7 and 8, and indicated by the notation "d", whereupon the arms will engage side flaps 49 of each successive cannon blank and slow to a "dwell" speed matched to the speed of the carton blank and the group of articles along the path of travel.

A series of illustrative cam profiles used by carton flap folding apparatus 5 are illustrated in FIGS. 7 and 8. The four cam profiles, 70, 72, 74, and 76 shown in FIG. 7 are for differing article sizes and configurations spaced on a 10 inch pitch from one another, whereas cam profile 78 of FIG. 8 is adapted for use with a 20 inch pitch, in which, for example, a 6 in-line group of articles is being moved along the path of travel.

Referring first to FIG. 7, each one cam profiles 70 to 76 has a deceleration portion denoted by the reference character "d", a dwell period denoted by the reference character "D", and an acceleration portion or period denoted by the reference character "a". For the 10 inch pitch shown in FIG. 7, two carton blanks 13 will be wrapped around two separate groups of articles G during one 360° revolution of knock-down arms 32 on driven pulley assembly 28, which is equal to one complete revolution of servomotor 40. This, of course, will depend on the gearing of gear reducer 39, which for illustrative purposes here is a one-to-one gear ratio. As is known to those skilled in the art, however, the gear ratio of gear reducer 39 may be varied in connection with the physical design of knock-down arms 32 to arrive at different speed ratios desired for the cam profiles to be used in packaging the groups of articles on the packaging machine.

Referring to cam profile 70 of FIG. 7, therefore, at the 0° point along the X-axis, which represents the distance traveled by the knock-down arm in the direction of the path of travel, the Y-axis representing the rotational position of the knock-down arm, the knock-down arm is being slowed or decelerated until it reaches a dwell point at approximately 80° to 85° along the X-axis, whereupon the speed of the knock-down arm will be matched to the speed of the group of articles along the path travel. At the 95° to 100° point along the X-axis the knock-down arm is accelerated to complete one-half of the cycle whereupon the second half of the packaging cycle starts at the 180° point, the knock-down arms being dwelled at the 260° to 265° point and accelerated again at the 275° to 280° point. Cam profile 70 shown in FIG. 7 would typically be used for a six pack such as illustrated in FIG. 5, for example, in which a neck-through configuration is used, in that knock-down arms 32 will engage side flaps 49 later than they would side flaps 45 of the over the crown carton blank configuration illustrated in FIG. 2 so that the knockdown arms are rotated more quickly, as compared to cam profiles 74 and 76, in order to engage the carton blank side flaps. This is required because the knock-down arms must typically travel through a greater distance to contact the side flaps of a neck-through package than the side flaps of an over the crown package.

Cam profile 74 shown in FIG. 7 has been phase shifted with respect to the phase of cam profiles 70 and 72 so that the dwell portion occurs sooner than it does with cam profiles 70, 72 and 76. This is desirable for maximizing packaging efficiency as the speed of knock-down arms 32 should be matched as soon as possible to the speed of the group of articles, and the carton blank, because once the knock-down arms engage the carton blank more control is provided for assuring that the carton blank is moved with the articles, rather than with respect to the articles, along the path of travel. Cam profile 74 as shown in FIG. 7 would likely be used with an over the crown configuration as opposed to cam profiles 70 or 72 as it indicates the side flaps of the carton blank will be engaged by knock-down arms 32 at a point sooner in the rotation of the knock-down arm and with a lesser degree of deceleration because the knock-down arms strike the side flaps sooner than they would if this were a neck-through configuration, shown for cam profiles 70 and 72 in FIG. 7. In similar fashion, therefore, cam profile 76 would also be used with over the crown carton blanks as it accelerates and decelerates the knock-down arms at approximately half the rate of cam profiles 70 and 72.

FIG. 8 illustrates a cam profile used with a 20 inch pitch, for example, a 6×1 article configuration extending along the path of travel. Cam profile 78, however, follows the same pattern employed by the cam profiles of FIG. 7 in that it has a deceleration period, a dwell period, and an acceleration period for one 360° cycle for one single carton, rather than for two cartons.

While a preferred embodiment of the invention has been disclosed in the foregoing specification, it is understood by those skilled in the art, that variations and modifications thereof can be made without departing from the spirit and scope of the invention as set forth in the following claims. In addition, the corresponding structures, materials, acts, and equivalents of all means or step plus function elements in the claims below are intended to include any structure, material or acts for performing the functions in combination with other claimed elements as specifically claimed herein.

We claim:

1. A method of packaging a pre-formed group of articles being moved along a path of travel on a packaging machine, said method comprising the steps of:

a) partially enclosing the group of articles as it moves along the path of travel in a prescored carton blank having at least one generally open flap hingedly connected thereto;

b) moving a carton flap folding means positioned on the packaging machine with respect to the path of travel in the direction of the path of travel and engaging the at least one open flap of the carton blank in response thereto;

c) folding the at least one open flap of the carton blank into a generally closed position on the carton blank with said flap folding means; and e) varying the speed of said flap folding means in the direction of the path of travel with respect to the speed of the group of articles.

2. The method of claim 1, wherein step b) further comprises the step of moving said flap folding means in the direction of the path of travel at substantially the same speed as the speed of the group of articles moving along the path of travel while engaging the at least one open flap of the carton blank.

3. The method of claim 1, wherein step b) further comprises the step of decreasing the speed of said flap folding means in the direction of the path of travel prior to engaging the at least one open flap of the carton blank.

4. The method of claim 1, step e) further comprising the step of disengaging said flap folding means from the at least one open flap of the carton blank while varying the speed of said flap folding means in the direction of the path of travel.

5. The method of claim 4, further comprising the step of increasing the speed of said flap folding means in the direction of the path of travel while disengaging the at least one open flap of the carton blank from said flap folding means.

6. A method of folding a wrap-type carton blank about a preformed group of articles on a packaging machine, the packaging machine having an infeed end, a spaced discharge end, a path of travel extending from the infeed end toward the discharge end, a supply of generally flat and prescored wrap-type carton blanks, each carton blank having a top panel and at least one open side flap hingedly connected thereto, and a carton flap folding assembly supported on the packaging machine with respect to the path of travel, the carton flap folding assembly including at least one knock down arm positioned with respect to the path of travel, said method comprising the steps of:

a) moving the group of articles along the path of travel at a predetermined rate of speed;

b) positioning the top panel of one of the carton blanks on the group of articles as the group of articles is moved along the path of travel;

c) rotating the at least one knock down arm of the carton flap folding assembly in the direction of the path of travel and engaging the at least one open side flap of the carton blank with the at least one knock down arm as the group of articles moves along the path of travel;

d) folding the at least one open side flap of the carton blank at least partially about the group of articles in response thereto; and e) varying the speed of the at least one knock down arm in the direction of the path of travel with respect to the predetermined speed of the group of articles and disengaging the at least one knock down arm from the at least one open side flap of the carton blank in response thereto.

7. The method of claim 6, wherein step c) comprises the step of rotating the at least one knock down arm of the carton flap folding assembly in the direction of the path of travel and engaging the at least one open side flap of the carton blank at substantially the same speed as the group of articles moving along the path of travel.

8. The method of claim 6, wherein step c) comprises the step of decreasing the speed of the at least one knock down arm in the direction of the path of travel with respect to the speed of the group of articles moving along the path of travel prior to engaging the at least one open side flap of the carton blank.

9. The method of claim 6, wherein step e) comprises the step of increasing the speed of the at least one knock down arm in the direction of the path of travel with respect to the predetermined rate of speed of the group of articles moving along the path of travel.

10. A method of folding a wrap-type carton blank about one of a spaced series of pre-formed groups of articles moving along a path of travel on a packaging machine, the packaging machine having a supply of generally flat and prescored wrap-type carton blanks, each carton blank having a top panel and at least one pair of opposed side flaps hingedly connected thereto, and a carton flap folding assembly supported on the packaging machine with respect to the path of travel, the carton flap folding assembly including a spaced pair of generally parallel knock down arms rotated in the direction of the path of travel, said method comprising the steps of:

a) positioning the top panel of one of the carton blanks on one of the groups of articles and moving the group of articles and the carton blank together along the path of travel;

b) decreasing the speed of the knock down arms in the direction of the path of travel with respect to the speed of the group of articles along the path of travel;

c) moving the knock down arms into engagement with one each of the side flaps of the carton blank in the direction of the path of travel at substantially the same speed as the speed of the group of articles along the path of travel;

d) folding the side flaps of the carton blank at least partially about the group of articles in response thereto; and e) increasing the speed of the knock down arms in the direction of the path of travel with respect to the speed of the group of articles and disengaging the knock down arms from the side flaps of the carton blank in response thereto.

11. A carton flap folding apparatus for use on a packaging machine on which a spaced series of preformed groups of articles are being moved along a path of travel, each of the groups of articles being at least partially enclosed in a prescored carton, each carton having at least one open flap hingedly connected thereto for being closed on the carton, said carton flap folding apparatus comprising:

a framework supported on the packaging machine with respect to the path of travel; flap folding means supported on said framework for rotation in the direction of the path of travel, said flap folding means being constructed and arranged for engagement with the at least one open flap of the cartons as the groups of articles are moved along the path of travel;

drive means, supported on said framework, for rotating said flap folding means in the direction of the path of travel; and control means for varying the speed of said flap folding means in the direction of the path of travel with respect to the speed of the groups of articles along the path of travel.

12. The apparatus of claim 11, wherein said control means is constructed and arranged to decrease the speed of said flap folding means in the direction of the path of travel with respect to the speed of the groups of articles moving along the path of travel, and to move said flap folding means into engagement with the at least one open flap of each carton as each group of articles is moved along the path of travel.

13. The apparatus of claim 12, said control means being constructed and arranged to move said flap folding means in the direction of the path of travel at substantially the same speed as the speed of the groups of articles moving along the path of travel while engaged with the at least one open flap of each of the cartons.

14. The apparatus of claim 12, wherein said control means is constructed and arranged to increase the speed of said flap folding means in the direction of the path of travel with respect to the speed of the groups of articles along the path of travel to disengage said flap folding means from the at least one open flap of each of the cartons.

15. A carton flap folding apparatus for folding a wrap-type carton blank about a preformed group of articles moving at a predetermined rate of speed along a path of travel on a packaging machine, the packaging machine having a storage magazine supplied with a plurality of generally flat and prescored wrap-type carton blanks, each cannon blank having a top panel and at least one pair of opposed side flaps hingedly connected thereto, and a canon blank feed assembly for positioning the top panel of one of the canon blanks on the group of articles as it moves along the path of travel, said carton flap folding apparatus comprising:

a framework supported on the packaging machine with respect to the path of travel;

a spaced pair of generally parallel knock down arms supported on said framework for rotation in the direction of the path of travel, said pair of knock down arms being constructed and arranged for engagement with one each of the side flaps of the carton blank for folding the side flaps of the carton blank at least partially about the group of articles as the group of articles moves along the path of travel;

drive means, supported on said framework, for rotating said spaced pair of knock down arms in the direction of the path of travel; and control means for varying the speed of the knock down arms in the direction of the path of travel with respect to the predetermined speed of the group of articles along the path of travel.

16. The apparatus of claim 15, said control means being constructed and arranged to move said pair of knock down arms into engagement with one each of the side flaps of the carton blank in the direction of the path of travel at substantially the same speed as the speed of the group of articles along the path of travel.

17. The apparatus of claim 16, wherein said control means is constructed and arranged to decrease the speed of said pair of knock down arms in the direction of the path of travel with respect to the predetermined rate of speed of the group of articles along the path of travel prior to engaging said knock down arms on the side flaps of the carton blank.

18. The apparatus of claim 16, wherein said control means is constructed and arranged to increase the speed of said pair of knock down arms in the direction of the path of travel with respect to the predetermined rate of speed of the group of articles along the path of travel to disengage said knock down arms from the side flaps of the carton blank.

19. The apparatus of claim 15, said control means comprising a control processor, said control processor including a memory and at least one electronic cam profile stored within said memory, said at least one electronic cam profile being used by said control processor to vary the speed of said drive means for varying the speed of said pair of knock down arms with respect to the speed of the group of articles along the path of travel.

20. The apparatus of claim 15, said apparatus further comprising:

a driven pulley assembly supported on said framework, said pair of knock down arms being supported for rotation on said driven pulley assembly;

a drive pulley supported on said framework and spaced from said driven pulley assembly; and an endless timing belt encircling said driven pulley assembly and said drive pulley;

said drive means comprising a gear reducer operably connected to said drive pulley, and a servomotor operably connected to said gear reducer for rotating said pair of knock down arms in the direction of the path of travel.

21. The apparatus of claim 20, further comprising:

an encoder formed as a part of said servomotor, said encoder being constructed and arranged to emit a servomotor drive position signal;

wherein said control means comprises a control processor constructed and arranged to receive said drive position signal, said control processor including a memory and at least one electronic cam profile stored within said memory, said control processor being constructed and arranged to compare said drive position signal to said at least one electronic cam profile and to emit a servomotor drive control signal to said servomotor to vary the speed of said servomotor for varying the speed of said pair of knock down arms with respect to the speed of the group of articles along the path of travel.

22. A packaging machine, the packaging machine being supplied with a spaced series of groups of articles, a carton feed magazine, the carton feed magazine being supplied with a plurality of prescored carton blanks, each carton blank having at least one open flap for being closed on the carton, said packaging machine comprising:

a framework having an infeed end for receiving the spaced series of groups of articles, and a spaced discharge end for passing the groups of articles from the machine;

a path of travel extending along the framework from said infeed end toward said discharge end;

an endless conveyor supported on the framework and constructed and arranged to move the groups of articles along the path of travel;

a carton blank feed assembly supported on the framework with respect to said conveyor, said carton blank feed assembly being constructed and arranged to position one of the carton blanks on each of the groups of articles moving along the path of travel;

a carton flap folding assembly supported on the framework downstream of said carton blank feed assembly and positioned with respect to the groups of articles being carried on said conveyor;

said carton flap folding assembly having a flap folding means for rotation in the direction of the path of travel, said flap folding means being constructed and arranged to engage the at least one open flap of the cartons and to at least partially enclose the articles within the cartons as the groups of articles are moved along the path of travel, drive means for rotating said flap folding means in the direction of the path of travel, and control means for varying the speed of said flap folding means in the direction of the path of travel with respect to the speed of the groups of articles along the path of travel; and an endless discharge conveyor supported on said framework downstream of said conveyor for discharging the groups of articles from the packaging machine.

23. The apparatus of claim 22, wherein said control means is constructed and arranged to decrease the speed of said flap folding means in the direction of the path of travel with respect to the speed of the groups of articles moving along the path of travel, and to move said flap folding means into engagement with the at least one open flap of each carton as each group of articles is moved along the path of travel.

24. The apparatus of claim 22, said control means being constructed and arranged to move said flap folding means in the direction of the path of travel at substantially the same speed as the speed of the groups of articles moving along the path of travel while engaged with the at least one open flap of each of the cartons.

25. The apparatus of claim 22, wherein said control means is constructed and arranged to increase the speed of said flap folding means in the direction of the path of travel with respect to the speed of the groups of articles along the path of travel and to disengage said flap folding means from the at least one open flap of each of the cartons.

26. The apparatus of claim 22, said flap folding means comprising:

a framework;

a spaced pair of generally parallel knock down arms supported on said framework;

a driven pulley assembly supported on said framework, said pair of knock down arms being supported for rotation in the direction of the path of travel on said driven pulley assembly;

a drive pulley supported on said framework and spaced from said driven pulley assembly; and an endless timing belt encircling said driven pulley assembly and said drive pulley;

said drive means comprising a gear reducer operably connected to said drive pulley, and a servomotor operably connected to said gear reducer for rotating said pair of knock down arms in the direction of the path of travel.

27. The apparatus of claim 26, further comprising:

an encoder formed as a part of said servomotor, said encoder being constructed and arranged to emit a servomotor drive position signal;

wherein said control means comprises a control processor constructed and arranged to receive said drive position signal, said control processor including a memory and at least one electronic cam profile stored within said memory, said control processor being constructed and arranged to compare said drive position signal to said at least one electronic cam profile and to emit a servomotor drive control signal to said servomotor to vary the speed of said servomotor for varying the speed of said pair of knock down arms with respect to the speed of the group of articles along the path of travel.

* * * * *